US005784669A

United States Patent [19]

Miura et al.

[11] Patent Number: 5,784,669

[45] Date of Patent: Jul. 21, 1998

[54] TONER REPLENISHING DEVICE FOR AN IMAGE FORMING APPARATUS

[75] Inventors: Tetsuro Miura; Satoshi Hatori, both of Tokyo; Leo Munakata, Yokohama, all of Japan

[73] Assignee: Ricoh Company Ltd., Tokyo, Japan

[21] Appl. No.: 725,169

[22] Filed: Oct. 3, 1996

[30] Foreign Application Priority Data

| | | | |
|---|---|---|---|
| Oct. 3, 1995 | [JP] | Japan | 7-255960 |
| Oct. 16, 1995 | [JP] | Japan | 7-266651 |
| Aug. 2, 1996 | [JP] | Japan | 8-204829 |

[51] Int. Cl.[6] ..... G03G 15/10

[52] U.S. Cl. ..... 399/58; 399/61; 399/258; 399/263

[58] Field of Search ..... 399/53, 58, 61, 399/62, 74, 224, 258, 260, 262, 263, 27

[56] References Cited

U.S. PATENT DOCUMENTS

| | | | |
|---|---|---|---|
| 4,963,929 | 10/1990 | Ueda et al. | 399/62 |
| 4,967,691 | 11/1990 | Chikama et al. | 399/62 |
| 5,005,516 | 4/1991 | Speer | 399/53 |
| 5,124,752 | 6/1992 | Kanno et al. | 399/53 |
| 5,172,168 | 12/1992 | Satoh et al. | 399/224 |
| 5,227,842 | 7/1993 | Hayashi et al. . | |
| 5,298,952 | 3/1994 | Kamijo et al. | 399/262 X |
| 5,557,379 | 9/1996 | Nakamura et al. | 399/260 X |

FOREIGN PATENT DOCUMENTS

| | | |
|---|---|---|
| 3-198072 | 8/1991 | Japan . |
| 4-34478 | 2/1992 | Japan . |

*Primary Examiner*—Sandra L. Brase

*Attorney, Agent, or Firm*—Oblon, Spivak, McClelland, Maier & Neustadt, P.C.

[57] ABSTRACT

In an image forming apparatus using dry toner, a toner replenishing device includes cleaning means for cleaning the sensing surface of remaining toner sensing means. The cleaning means is driven by the same drive source as agitating means for agitating the toner. To clean the sensing surface, the cleaning means is driven in a particular manner different from a manner for usual toner replenishment. While the cleaning means cleans the sensing surface, the output signal of the remaining toner sensing means is detected. The device achieves highly accurate toner concentration control and toner end detection at the same time.

5 Claims, 12 Drawing Sheets

TONER REPLENISHING DEVICE FOR AN IMAGE FORMING APPARATUS

BACKGROUND OF THE INVENTION

1. Field of the Invention

The present invention relates to a toner replenishing device for an image forming apparatus of the type including a developing device using dry toner.

2. Discussion of the Background

The prerequisite with a copier, facsimile apparatus, printer or similar image forming apparatus is high quality and stability of images. Particularly, it is a common practice with a digital copier to use a toner replenishment control system for stabilizing the toner concentration of a developer. The control system determines an amount of toner to be replenished from a toner replenishing section to a developer existing in a developing section. For this purpose, the system uses, as parameters, the amount of toner consumption estimated from image data, the toner concentration of the developer, etc. The system computes, based on such parameters and by use of a fuzzy theory, an amount of toner to be replenished. At this instant, the prerequisite is that the toner be replenished evenly over a preselected replenishable period of time (usually during development) so as to prevent the toner concentration from sharply changing or becoming offset. To meet this prerequisite, the system equally divides the replenishable time into blocks and determines an amount of replenishment for each block. Further, the system determines the duration of rotation of a toner conveying screw, taking account of the current toner replenishing ability of the toner replenishing section based on, e.g., the amount of remaining toner.

The image forming apparatus includes toner end sensing means for determining whether or not the amount of toner remaining in the replenishing section has reached a toner end condition, i.e., it is zero or approximately zero. The toner end sensing means is implemented as a piezoelectric toner end sensor. This kind of sensor needs a cleaning mechanism because it cannot operate accurately if toner deposits on its sensing surface. The cleaning mechanism is often implemented as a cleaning member mounted on an agitator which prevents toner from cohering. While the agitator is in rotation, the cleaning member wipes the sensing surface of the sensor.

In the apparatus of the type using the toner replenishment control system and cleaning mechanism described above, the agitator and toner conveying screw should preferably be driven by a single drive source from a cost standpoint.

An electrophotographic color image forming apparatus includes a toner replenishing device configured to replenish toner of particular color to each of a plurality of developing devices. This kind of apparatus allows an operator to select a full-color mode, monocolor mode or the like, as desired. The toner replenishing device has hopper portions respectively storing black toner, cyan toner, magenta toner, and yellow toner. A drive source (motor), an agitator for agitating the toner and a toner conveying screw are mounted on the individual hopper portion. The agitator and screw are driven by a single drive source via gears. Further, this toner replenishing device is operable in a toner loosening mode in which the agitator is rotated in opposite directions alternately in order to prevent the toner from cohering. The toner loosening mode operation is effected with each of the toner of four different colors when, e.g., the power switch of the apparatus is turned on for the first time in the morning or after a job corresponding to a preselected number of copies.

Although the above toner replenishment control system is operable with high accuracy, it has some problems yet to be solved, as follows. The toner conveying screw does not behave regularly, but sometimes almost stops, sometimes rotates intermittently, or sometimes rotates continuously, depending on momentary conditions surrounding it. Causing a single drive source to drive both the screw and the agitator is desirable in the cost aspect, as stated earlier. However, because the agitator moves in the same manner as the screw, the behavior of the cleaning member for cleaning the toner end sensor is unstable and discontinuous. This increases the probability that the cleaning member stops on the sensing surface of the sensor, and thereby prevents the cleaning member from surely cleaning the sensing surface. As a result, the output of the toner end sensor and therefore the toner end detection lacks stability. Theoretically, it is possible to estimate the behavior of the cleaning member and add the estimated behavior to the processing of the output of the sensor so as to enhance accurate toner end detection. However, this kind of approach is not practical because a prohibitive amount of data must be dealt with.

Moreover, because the screw and agitator are driven by a single drive source, the screw is rotated in opposite directions together with the agitator in the toner loosening mode. When the screw is rotated in the forward direction, it conveys toner, although in a small amount, from the hopper portion to the developing device. As a result, the toner concentration of the developer existing in the developing device is varied. Particularly, assume that the user of the color image forming apparatus often uses the black-and-white or similar monocolor mode. Then, every time the toner loosening mode operation is effected, the toner concentrations of the developing devices not used in the monocolor mode undesirably increase. Consequently, when the apparatus is occasionally operated in the full-color mode, defective images including images with excessive density are produced. In addition, the high concentration toner flies about within the apparatus.

SUMMARY OF THE INVENTION

It is therefore an object of the present invention to provide a toner replenishing device for an image forming apparatus and capable of achieving highly accurate toner concentration control and toner end detection at the same time and allowing, in a toner loosening mode, a minimum of toner to be conveyed to a developing device.

In accordance with the present invention, a toner replenishing device includes a hopper portion for storing toner therein. A remaining toner sensor has a sensing surface disposed in the hopper portion to thereby sense the toner existing in the hopper portion. An agitator agitates the toner in the hopper portion. A cleaning member is driven by the same drive source as the agitator for cleaning the sensing surface of the remaining toner sensor. A controller causes the cleaning member to clean the sensing surface by a drive different from a drive for usual toner replenishment, and detects the output of the remaining toner sensor while the cleaning member cleans the sensing surface.

Also, in accordance with the present invention, a toner replenishing device has a hopper portion for storing toner therein. An agitating member agitates the toner in the hopper portion. A toner conveying member is driven by the same drive source as the agitating member for replenishing the toner into a developing device. The drive transmission from the drive source to the toner conveying member is variable.

BRIEF DESCRIPTION OF THE DRAWINGS

The above and other objects features and advantages of the present invention will become apparent from the following detailed description taken with the accompanying drawings in which.

DESCRIPTION OF THE PREFERRED EMBODIMENTS

Figure 14:
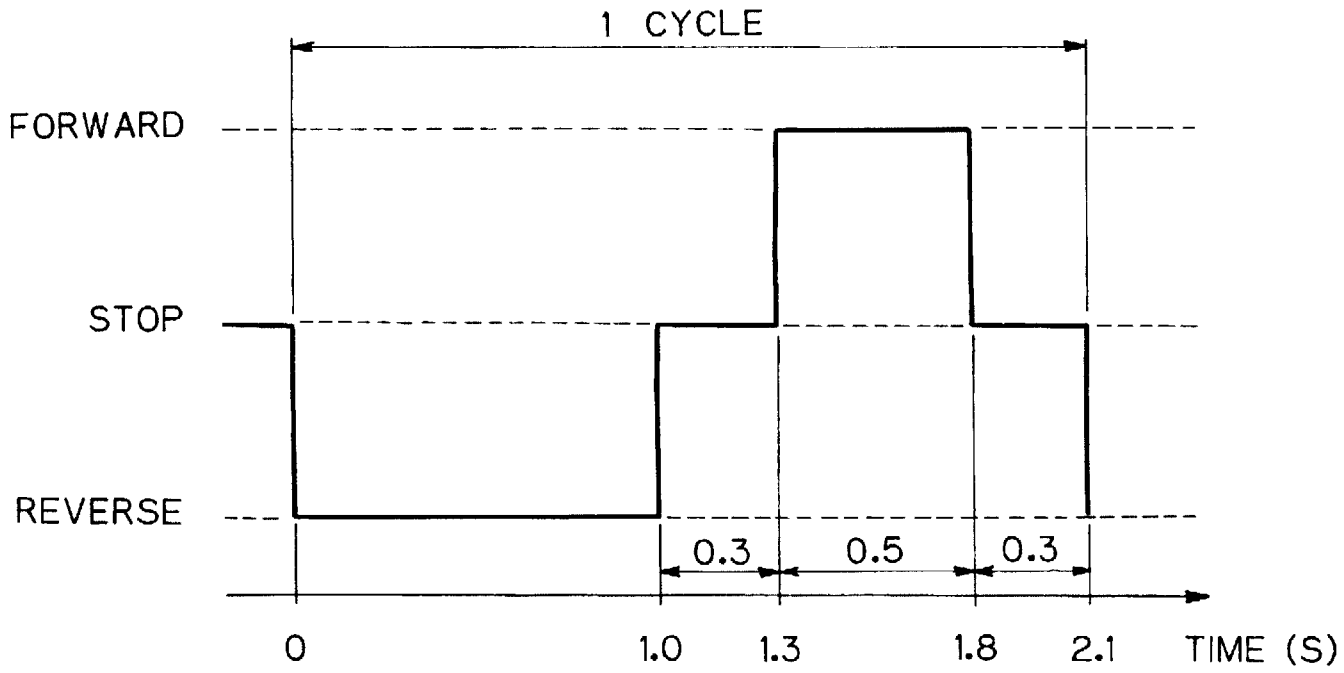
FIG. 14 is a timing chart demonstrating conventional agitator control effected in a toner loosening mode.

To better understand the present invention, a brief reference will be made to the control over an agitator effected in a conventional toner replenishment control system in a toner loosening mode, shown in FIG. 14. As shown, in the loosening mode, the rotation of the agitator is controlled in order to prevent toner from cohering. Specifically, the agitator is rotated in the reverse direction for 1.0 second, stopped for 0.3 second, rotated in the forward direction for 0.5 second, and then stopped for 0.3 second. This completes a single loosening cycle. Such a cycle is repeated five consecutive times. It is to be noted that the forward rotation of the agitator causes a screw for replenishing toner to convey the toner. The loosening mode operation is performed with each of toner of four different colors when, e.g., a power switch is turned on for the first time in the morning or after a job corresponding to a preselected number of copies.

Figure 5:
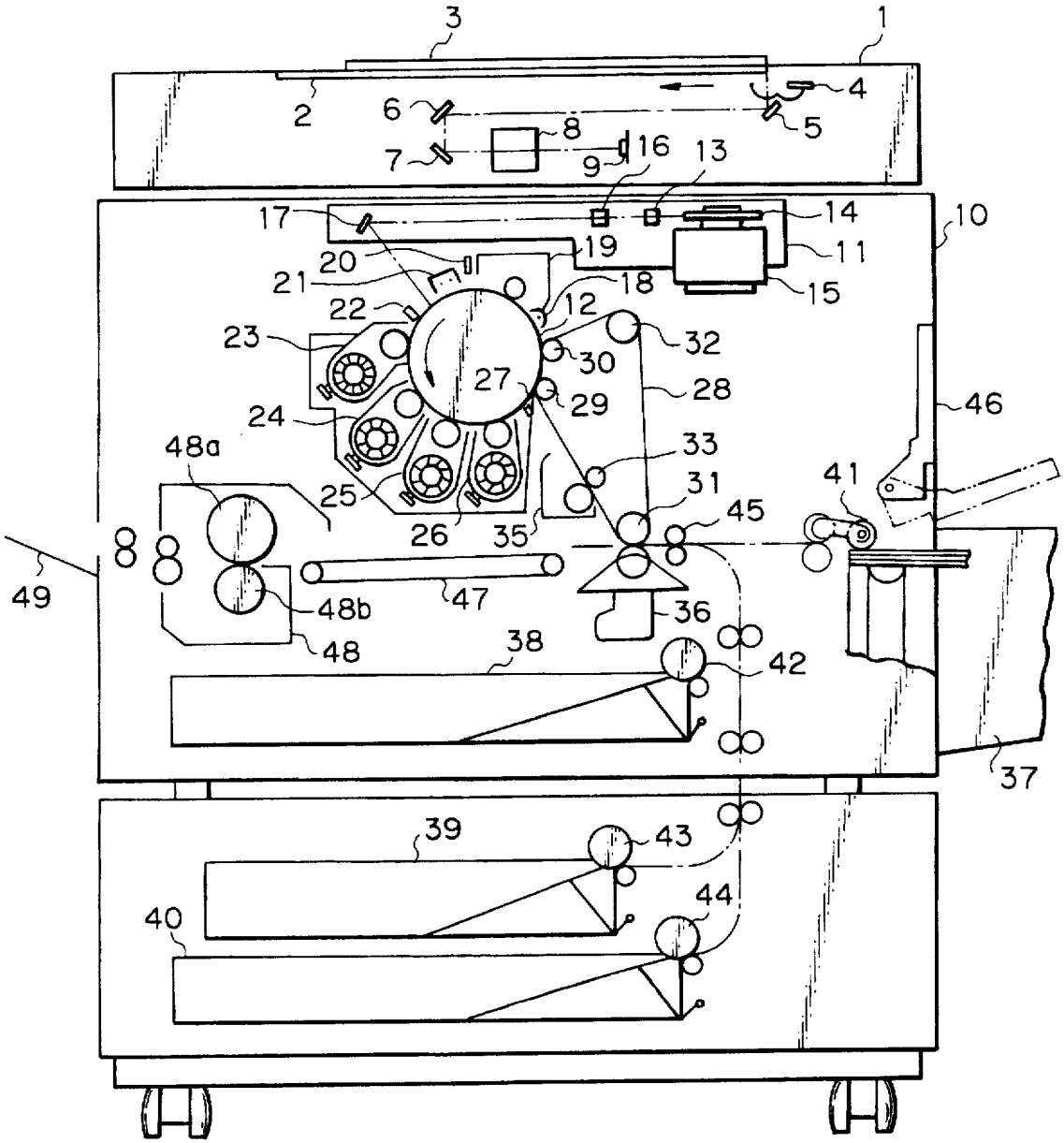
FIG. 5 is a section showing the general construction of the copier shown in FIG. 1.
Figure 6:
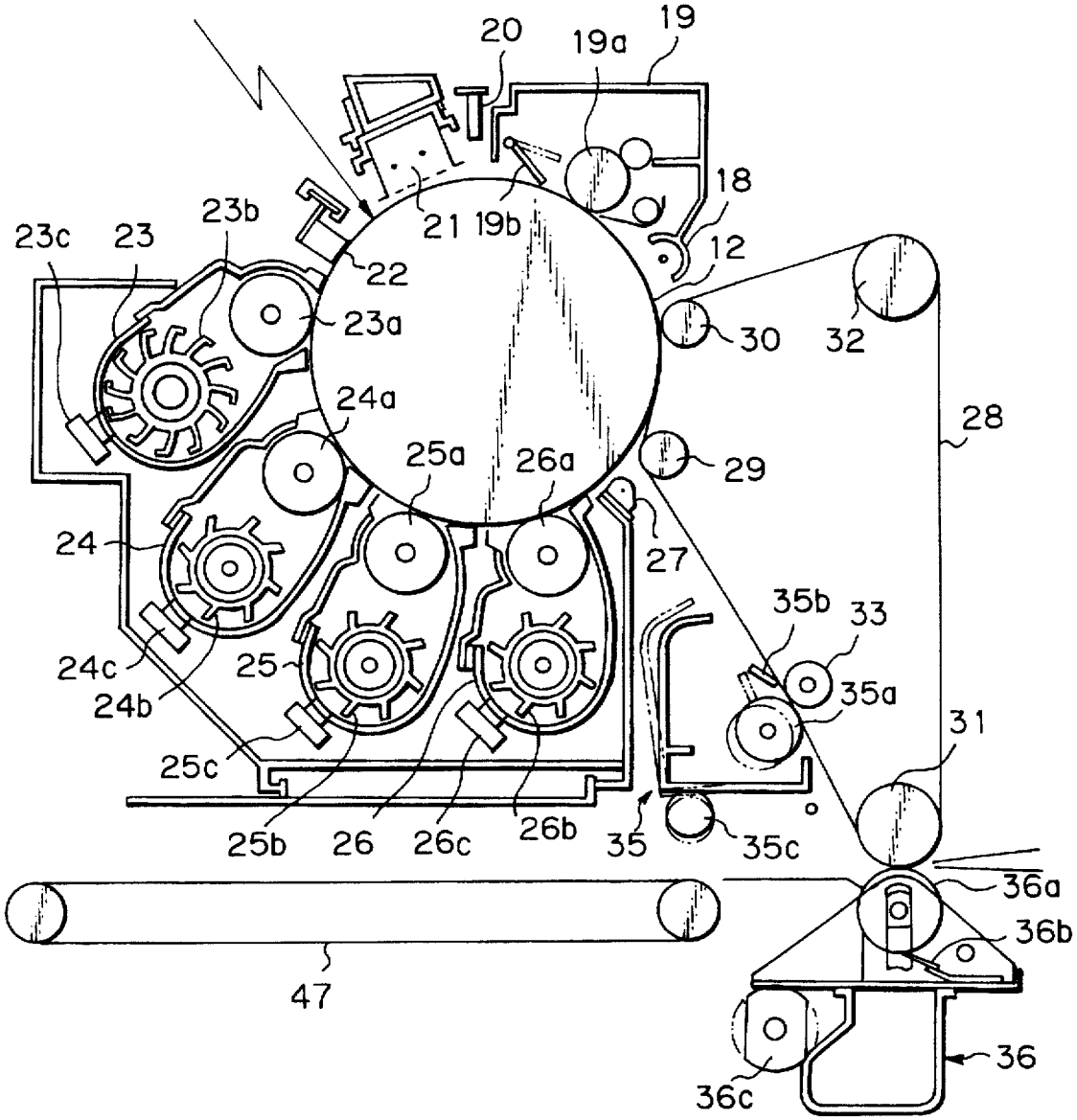
FIG. 6 is a section showing a part of the color copier of FIG. 5.

Referring to FIG. 5, an image forming apparatus incorporating a toner replenishing device representative of the first embodiment of the present invention is shown and implemented as an electrophotographic color copier. FIG. 6 shows a photoconductive element and an intermediate transfer belt included in the copier together with various members and units adjoining them. As shown, a color image reading device or color scanner 1 illuminates a document 3 laid on a glass platen 2 with a lamp 4. The resulting reflection from the document 3 is focused onto a color image sensor 9 via mirrors 5–7 and a lens 8. The color image sensor 9 reads the color image information of the document 3 while separating them into a blue (B) component, a green (G) component, and a red (R) component. As a result, electric B, G and R image signals respectively representative of the B, G and R components are output from the image sensor 9.

An image processor, not shown, transforms the B, G and R image signals to black (BK), cyan (C), magenta (M) and yellow (Y) color image data on the basis of their intensity levels. The BK, C, M and Y color image data are input to a color image recording device or color printer 10. In response, the color printer 10 sequentially forms BK, C, M and Y toner images one above the other and thereby completes a full-color image.

Specifically, a controller, not shown, sends a scanner start control signal synchronous to the operation of the color printer 10 to the color scanner 1. In response, the color scanner 1 causes the lamp 4 and optics 5–7 to move to the left, as indicated by an arrow in FIG. 5, scanning the document 3 on the glass platen 2. As a result, the image sensor 9 outputs image data of one color. The scanner 1 repeats the above scanning operation four consecutive times, so that the image processor sequentially outputs BK, C, M and Y image data. Every time the image data of one color are output, the color printer 2 forms a toner image of the same color. Consequently, toner images of such four colors are sequentially formed one above the other to complete a full-color image.

In the printer 10, every time an optical writing unit or writing means 11 receives an image forming signal representative of the image data of one color from the image processor, it transforms the signal to an optical signal and scans a photoconductive drum 12 with the optical signal. As a result, a latent image is electrostatically formed on the drum 12. The writing unit 11 includes a polygonal mirror 14 rotated by a motor 15. A laser drive controller, not shown, drives a semiconductor laser 13 in accordance with the image forming signal. A laser beam issuing from the laser 13 is steered by the polygonal mirror 14 and incident to the drum 12 via an f-θ lens 16 and a mirror 17.

The drum 12 is rotated counterclockwise, as indicated by an arrow in FIG. 5, by a drive mechanism, not shown. Arranged around the drum 12 are a drum cleaning device or cleaning means 19 (including a precleaning discharger 18), a discharge lamp or discharging means 20, a main charger or charging means 21, a potential sensor 22, a BK developing unit 23, a C developing unit 24, a M developing unit 25, a Y developing unit 26, a density pattern sensor 27 implemented by a photosensor, an intermediate transfer belt 28, etc. As shown in FIG. 6, the BK developing unit 23 includes a developing sleeve 23*a*, a paddle 23*b*, and a toner concentration sensor 23*c*. The developing sleeve 23*a* is rotatable with a developer deposited thereon contacting the surface of the drum 12. The paddle 23*b* is rotatable while scooping up and agitating the developer. The toner concentration sensor 23*c* is responsive to the toner concentration of the developer. Likewise, the C, M and Y developing units 24, 25 and 26 respectively include developing sleeves 24*a*, 25*a* and 26*a*, paddles 24*b*, 25*b* and 26*b*, and toner concentration sensors 24*c*, 25*c* and 26*c*.

In a stand-by condition, all the developers on the developing sleeves 23*a*–26*a* are held in their inoperative position.

The BK, C, M and Y developing units 23–26 are assumed to sequentially develop latent images in this order although such an order is only illustrative.

At the beginning of a copying operation, the drum 12 is rotated while being uniformly charged by the main charger 21. At a preselected timing, the color scanner 1 starts reading the document 3. On receiving the image data from the scanner 1, the image processor outputs BK image data. The writing unit 11 optically scans the drum 12 with the laser beam in accordance with the BK image data, thereby forming an electrostatic latent image on the drum 12. Let the latent images based on the BK, C, M and Y image data be referred to as BK, C, M and Y latent images, respectively.

In the BK developing unit 23, the developing sleeve **23*a* starts rotating with BK toner deposited thereon before the leading edge of the BK latent image arrives at a developing position assigned to the developing unit 23. As a result, the BK latent image is developed by the BK toner from its leading edge. As soon as the trailing edge of the BK latent image moves away from the developing position, the developer on the sleeve 23*a* is brought to its inoperative position. This is completed at least before the leading edge of the next latent image, i.e., C latent image, arrives at the developing position. To bring the developer to its inoperative position, the sleeve 23*a* is rotated in the reverse direction. During the above period, the other developing units 24–26** are held inoperative.

The BK toner image formed on the drum 12 is transferred to the surface of the transfer belt 28 being rotated at the same speed as the drum 12. Let the image transfer from the drum 12 to the transfer belt 28 be referred to as belt transfer. For the belt transfer, while the drum 12 and belt 28 are held in contact, a preselected bias voltage is applied to transfer bias rollers or electrodes 29 and 30. After the belt transfer of the BK toner image, the drum cleaning unit 19 including the precleaning discharger 18 discharges and cleans the drum 12. Then, the main charger 21 again charges the drum 12 uniformly. In this manner, the BK, C, M and Y toner images are sequentially transferred from the drum 12 to the belt 28 one above the other, completing a tetra or full-color toner image. The full-color image is transferred form the belt 28 to a paper or similar recording medium at a time. The configuration and operation of an intermediate transfer belt unit including the belt 28 will be described specifically later.

After the belt transfer of the BK toner image, the scanner 1 again starts reading the document 3 at a preselected timing. On receiving image data from the scanner 1, the image processor outputs C image data. The writing unit 11 scans the drum 12 with the laser beam in accordance with the C image data, thereby forming a C latent image on the drum 12. In the C developing unit 24, the developing sleeve **24*a* starts rotating and brings the developer to its operative position after the trailing edge of the BK latent image has moved away from a developing position assigned to the developing unit 24, but before the leading edge of the C latent image arrives thereat. As a result, the C latent image is developed by C toner included in the developer. As soon as the trailing edge of the C latent image moves away from the developing position, the developer on the sleeve 24*a*** is brought to its inoperative position. This is also completed before the leading edge of the next latent image, i.e., M latent image, arrives at the developing position.

The C toner image is transferred from the drum 12 to the transfer belt 28 being moved at the same speed as the drum 12. After the belt transfer of the C toner image, the drum cleaning unit 19 including the precleaning discharger 18 discharges and cleans the drum 12. Then, the main charger 21 again charges the drum 12 uniformly.

After the belt transfer of the C toner image, the scanner 1 again starts reading the document 3 at a preselected timing. On receiving image data from the scanner 1, the image processor outputs M image data. The writing unit 11 scans the drum 12 with the laser beam in accordance with the M image data, thereby forming an M latent image on the drum 12. In the M developing unit 25, the developing sleeve **25*a* starts rotating and brings the developer to its operative position after the trailing edge of the C latent image has moved away from a developing position assigned to the developing unit 25, but before the leading edge of the M latent image arrives thereat. As a result, the M latent image is developed by M toner included in the developer. As soon as the trailing edge of the M latent image moves away from the developing position, the developer on the sleeve 25*a*** is brought to its inoperative position. This is also completed before the leading edge of the next latent image, i.e., Y latent image, arrives at the developing position.

The M toner image is transferred from the drum 12 to the transfer belt 28 being moved at the same speed as the drum 12. After the belt transfer of the M toner image, the drum cleaning unit 19 including the precleaning discharger 18 discharges and cleans the drum 12. Then, the main charger 21 again charges the drum 12 uniformly.

After the belt transfer of the M toner image, the scanner 1 again starts reading the document 3 at a preselected timing. On receiving image data from the scanner 1, the image processor outputs Y image data. The writing unit 11 scans the drum 12 with the laser beam in accordance with the Y image data, thereby forming a Y latent image on the drum 12. In the Y developing unit 26, the developing sleeve **26*a* starts rotating and brings the developer to its operative position after the trailing edge of the M latent image has moved away from a developing position assigned to the developing unit 26, but before the leading edge of the Y latent image arrives thereat. As a result, the Y latent image is developed by Y toner included in the developer. As soon as the trailing edge of the Y latent image moves away from the developing position, the developer on the sleeve 26*a* is brought to its inoperative position. This is completed after the trailing edge of the Y latent image has arrived at the developing position. The Y toner image is transferred from the drum 12 to the transfer belt 28 being moved at the same speed as the drum 12**.

The intermediate transfer belt unit will be described specifically. The belt 28 is passed over a drive roller 31 and rollers 32 and 33 as well as over the bias rollers 29 and 30. A motor, not shown, drives the drive roller 31 for thereby causing the belt 28 to rotate. A belt cleaning device 35 includes a brush roller **35*a*, a rubber blade 35*b*, and a moving mechanism 35*c* for moving the cleaning device 35 into and out of contact with the belt 28. After the belt transfer of the first or BK toner image, the mechanism 35*c* maintains the brush roller 35*a* and rubber blade 35*b* spaced from the belt 28 during the transfer of the C, M and Y toner images to the belt 28**.

A paper transfer unit 36 includes a bias roller **36*a*, a roller cleaning blade 36*b*, and a moving mechanism 36*c* for moving the bias roller 36*a* into and out of contact with the belt 28. Let the transfer of the full-color image from the belt 28 to the paper be referred to as paper transfer. The bias roller 36*a* is usually spaced from the belt 28. When the full-color image formed on the belt 28 is to be transferred from the belt 28 to the paper, the moving mechanism 36*c*** brings the roller 36a into contact with the belt 28. In this condition, a bias power source, not shown, applies a preselected bias voltage for paper transfer to the bias roller 36a. As a result, the image is transferred from the belt 28 to the paper being passed through between the bias roller 36a and the belt 28.

The paper is fed from a desired one of paper cassettes 37–40 toward a registration roller pair 45 by one of pick-up rollers 41–44 associated with the cassette. Alternatively, the paper may be fed from a manual feed tray 46 toward the registration roller pair 45 by a pick-up roller 41. The roller pair 45 stops the paper and then drives it at such a timing that the leading edge of the full-color image on the belt 28 arrives at a paper transfer position where the bias roller 36a is located.

After the first or BK toner image has been fully transferred from the drum 12 to the belt 28, the belt 28 may be moved in any one of three different modes, i.e., a constant speed forward mode, a skip forward mode, and a quick return or back-and-forth mode. These modes are used either individually or in combination in matching relation to the copy size in the aspect of copying speed. The three modes are as follows.

(1) Constant Speed Forward Mode

The belt 28 is moved forward at a constant speed even after the belt transfer of the BK toner image. The C image is formed on the drum 12 such that the leading edge of the C toner image just arrives at a belt transfer position or nip between the belt 28 and the drum 12 when the leading edge of the BK image is again brought to the above position by the belt 28. As a result, the C image is transferred from the drum 12 to the belt 28 in accurate register with the BK image. This is repeated to effect the belt transfer of the M and Y images. After the belt transfer of the last or Y image, the belt 28 is continuously moved forward so as to transfer the full-color image to the paper.

(2) Skip Forward Mode

After the belt transfer of the BK image, the belt 28 is released from the drum 12, then caused to skip a preselected distance forward at a high speed, and then returned to its initial speed. Subsequently, the belt 28 is again brought into contact with the drum 12. The C image is formed on the drum 12 such that the leading edge of the C image just arrives at the belt transfer position when the leading edge of the BK image is again brought to the above position by the belt 28. As a result, the C image is transferred from the drum 12 to the belt 28 in accurate register with the BK image. This is repeated to effect the belt transfer of the M and Y images. After the belt transfer of the Y image, the belt 28 is continuously moved forward so as to transfer the full-color image to the paper.

(3) Quick Return Mode

After the belt transfer of the BK image, the belt 28 is released from the drum 12, then brought to a stop, and then moved in the reverse direction at a high speed immediately. The return of the belt 28 is stopped after the leading edge of the BK image on the belt 28 has moved away from the belt transfer position and further moved a preselected distance. When the leading edge of the C image formed on the drum 12 arrives at a preselected position short of the belt transfer position, the belt 28 is again driven in the forward direction and again brought into contact with the drum 12. Again, the C image is transferred from the drum 12 to the belt 28 in accurate register with the BK image. This is repeated to effect the belt transfer of the M and Y images. After the belt transfer of the Y image, the belt 28 is not returned, but moved forward at the same speed so as to transfer the full-color image to the paper.

The paper carrying the full-color toner image transferred thereto from the belt 28 is conveyed to a fixing unit 38 by a conveyor unit 47. In the fixing unit 38, a heat roller 48a controlled to a preselected temperature and a press roller 48b cooperate to fix the toner image on the paper by heat. The paper coming out of the fixing unit 48 is driven out toward a tray 49 as a full-color copy. After the belt transfer, the drum cleaning device 19 discharges the drum 12 uniformly with the precleaning discharger 18 and cleans the surface of the drum 12 with the cleaning members 19a and 19b. Likewise, after the paper transfer of the toner image, the cleaning unit 35 cleans the surface of the belt 28 while being pressed against the belt 28 by the moving mechanism 35c.

In a repeat copy mode for producing a plurality of copies continuously, the operation of the scanner 1 and the image formation with the drum 12 start after the fourth or Y image formation meant for the first paper, and the first or BK image formation meant for the second paper starts at a preselected timing.

After the transfer of the full-color image from the belt 28 to the first paper, the cleaning device 35 cleans the surface of the belt 28. The BK image meant for the second paper is formed on the cleaned surface of the belt 28. This is also followed by the procedure described in relation to the first paper.

The paper cassettes 37–40 are each loaded with papers of particular size. When a desired paper size is entered on an operation panel, not shown, the paper of desired size is fed from one of the cassettes 37–40 toward the registration roller pair 45 by an associated one of the pick-up rollers 41–44. The manual feed tray 46 is available for OHP (Over Head Projector) sheets and relatively thick sheets.

While the foregoing description has concentrated on a full-color copy mode, the above operation will be repeated even in a tricolor or bicolor copy mode a number of times corresponding to the desired number of colors and desired number of copies entered on the operation panel. In a monocolor copy mode, only one of the developing units 23–26 is held operative until a desired number of monocolor copies have been produced. In this case, the belt 28 is driven forward at a constant speed in contact with the drum 12. Likewise, the belt cleaning unit 35 is held in contact with the belt 28.

Figure 3:
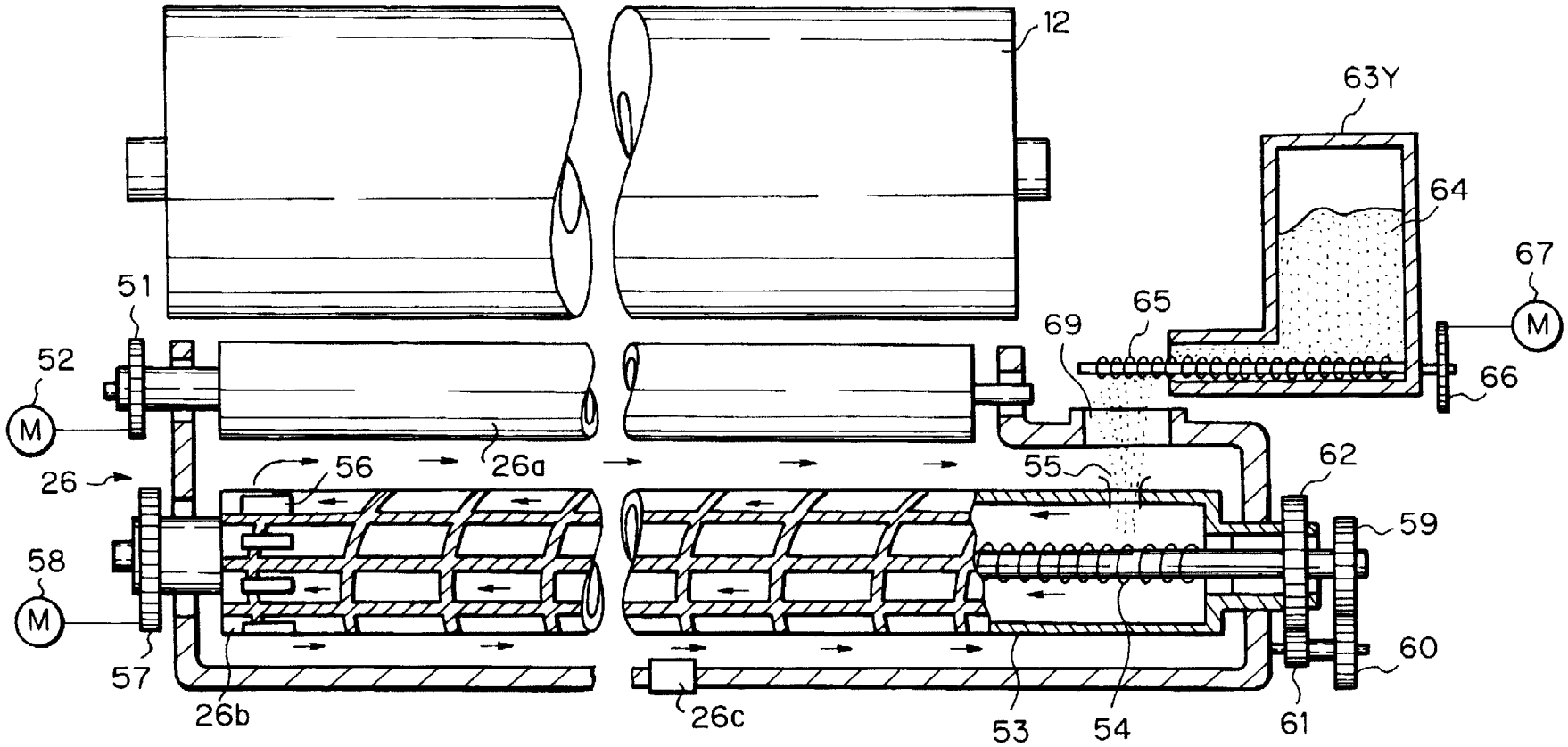
FIG. 3 is a fragmentary section showing a part of the first embodiment.

Referring to FIG. 3, the color copier is shown in a fragmentary enlarged view. As shown, the developing sleeve 26a of the Y developing unit 26 is spaced from the drum 12 by a predetermined gap. The sleeve 26a is supported by opposite side walls of the developing unit 26. A gear 51 is mounted on one end of the shaft of the sleeve 26. A motor 52 drives the sleeve 26a in the forward direction via the gear 51 during development, and reverses it when the developer should be brought to its inoperative position. The paddle 26b is a so-called dual mixer having an outer screw paddle 53 and an inner screw paddle 54. These screw paddles 53 and 54 convey the developer in opposite directions to each other while in rotation.

Specifically, the developer enters the paddle 26b via an inlet 55 adjoining one end of the outer screw paddle 53. The inner screw paddle 54 in rotation conveys the developer from the right to the left, as viewed in FIG. 3, within the paddle 26b. Then, the developer flows out of the paddle 26b via outlets 56 adjoining the other end of the paddle 26b. The outer screw paddle 53 in rotation conveys the developer flown out of the paddle 26b from the left to the right, as viewed in FIG. 3. As a result, the toner to be replenished is uniformly scattered and charged. A motor 58 drives the outer screw paddle 53 via a gear 57 mounted on the left or rear end of the paddle 53. The screw paddle 53 in turn rotates the inner screw paddle 54 via gears 59–62 mounted on the paddles 53 and 54.

The toner concentration sensor 26c is positioned in the vicinity of the paddle 26b and substantially at the intermediate between the axially opposite ends of the sleeve 26a. The sensor 26c determines the toner concentration of the Y developer existing in the developing unit 26 in terms of the permeability of the developer. A toner hopper unit or Y toner replenishing device 63Y stores fresh toner 64 to be replenished. A motor 67 drives a screw 65 via a gear 66 mounted on one end of the screw 65. The screw 65 feeds the fresh toner into the Y developing unit 26 via an opening 69.

The BK developing unit 23, C developing unit 24 and M developing unit 25 are identical in construction with the Y developing unit 26, and each replenishes toner from the respective toner hopper units 63BK, 63C or 63M.

Figure 4B:
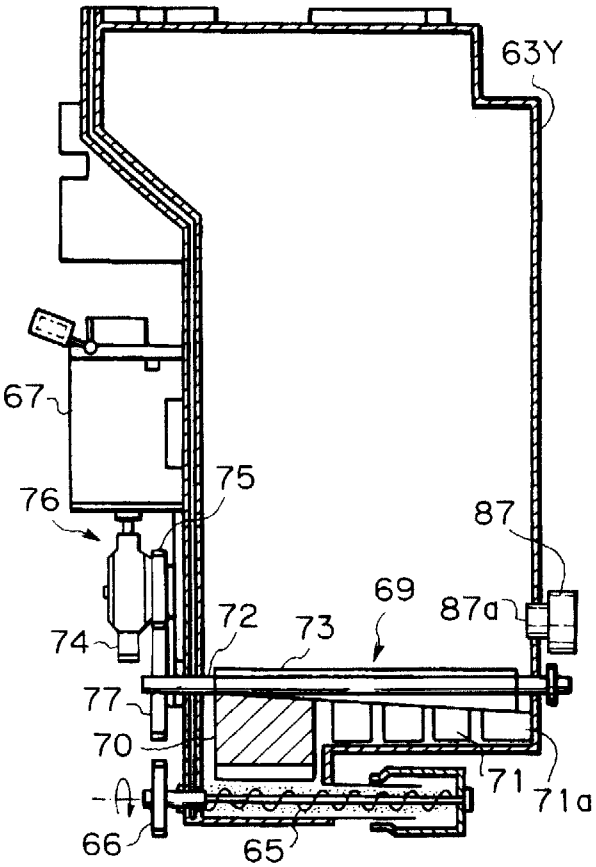
FIGS. 4A and 4B are fragmentary sections showing another part of the first embodiment.
Figure 4A:
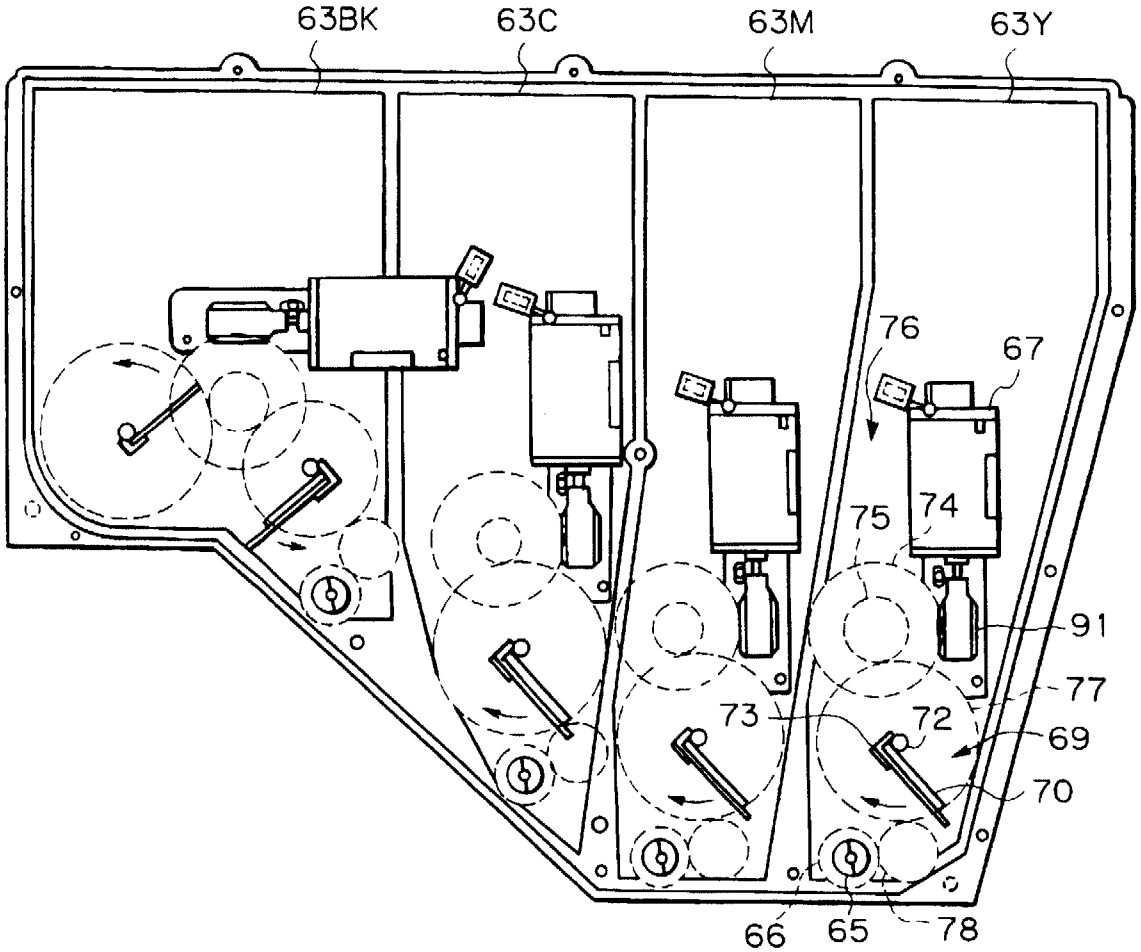

As shown in FIGS. 4A and 4B, the toner hopper units 63BK, 63C, 63M and 63Y respectively assigned to the developing units 23–26 are constructed into a single toner hopper unit and identical in configuration. The difference is that the toner hopper unit 63BK has two toner agitating means while the other toner hopper units 63C, 63M and 63Y have one toner agitating unit each. Let the following description concentrate on the toner hopper unit 63Y by way of example.

The toner hopper unit 63Y has a rotatable agitator or toner agitating means 69 for agitating, in the toner loosening mode, fresh toner 64 stored in the unit 63Y. The agitator 69 is made up of a blade 70 and a plurality of blades 71 having the same configuration. The blade 70 agitates the toner 64 at a position for feeding it to the screw 65. The blades 71 agitate the toner 64 at positions other than the above position. The blades 70 and 71 are affixed to a shaft 72 by an affixing member 73. All the blades 70 and 71 are formed of rubber and therefore elastic. In the toner loosening mode, the agitator 69 is rotated in the forward and reverse directions alternately so as to loosen the toner 64 in the toner hopper unit 63Y. Therefore, even if the toner 64 coheres when left unused for a long period of time or subjected to vibration, it can be effectively loosened. The screw 65 is positioned below the agitator 69.

A worm 91 is mounted on the output shaft of the motor 67 mounted on the toner hopper unit 63Y. A helical gear 76 is made up of a larger diameter gear 74 and a smaller diameter gear 75. The worm 91 is held in mesh with the larger diameter gear 74. A gear 77 is mounted on the end of a shaft 72 included in the agitator 69. The gear 77 is held in mesh with the smaller diameter gear 75. The gear 66 is mounted on the end of the screw 65 and connected to the gear 77 by a gear 78. The rotation of the motor 67 is transferred to the agitator 69 and screw 65 via the worm 91, helical gear 76, and gears 77, 78 and 66. The agitator 69 and screw 65 are rotatable at a speed of 34.6 rpm and a speed of 100 rpm, respectively.

FIGS. 7A–7D show a portion where the Y developer 26 and toner hopper unit 63Y join each other. As shown, the toner hopper unit 63Y has a hopper portion 79 storing the toner 64, a tube 80 positioned in a lower portion of the unit 63Y, the screw 65, a sleeve 81, a packing member 82, the gear 66, a spring 83, and a wiper member 84. The screw 65 is disposed in the tube 80 and rotatable to feed the toner 64 in a direction indicated by an arrow in FIG. 7A. The sleeve 81 is slidably mounted on the outer periphery of the tube 80. The packing member 82 is mounted on the end of the screw 65 and slightly smaller in diameter than the sleeve 81 so as to be capable of abutting against the sleeve 81. The spring 83 constantly biases the sleeve 81 against the packing member 82. The wiper member 84 wipes the outer periphery of the tube 80 in order to remove the toner 64.

Figure 7A:
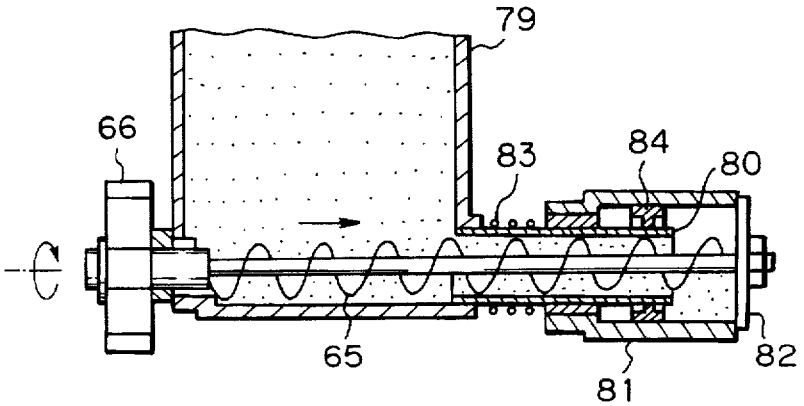
FIGS. 7A–7D are sections showing a part of a toner hopper unit included in the embodiment and the toner hopper unit and a developing device in a condition before connection, a condition during connection, and a condition after connection.
Figure 7B:
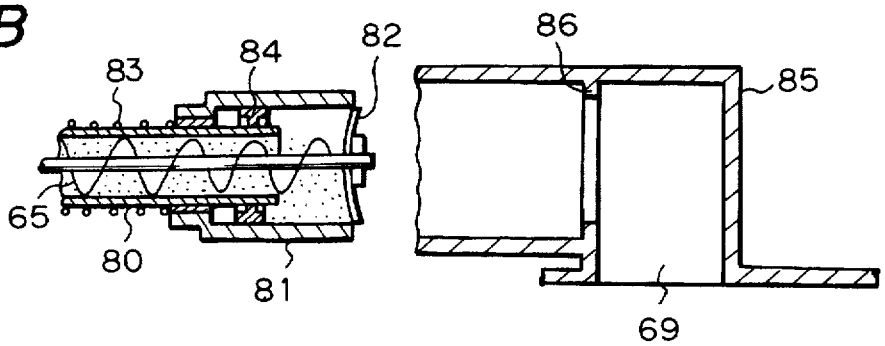
Figure 7C:
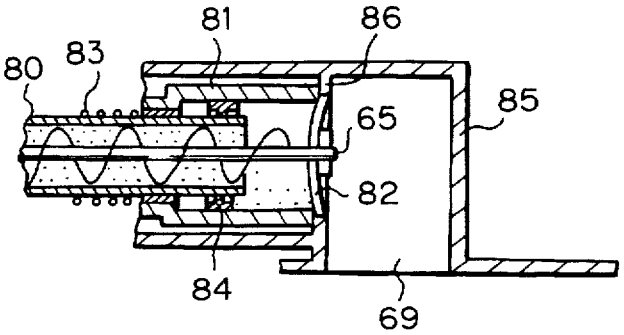
Figure 7D:
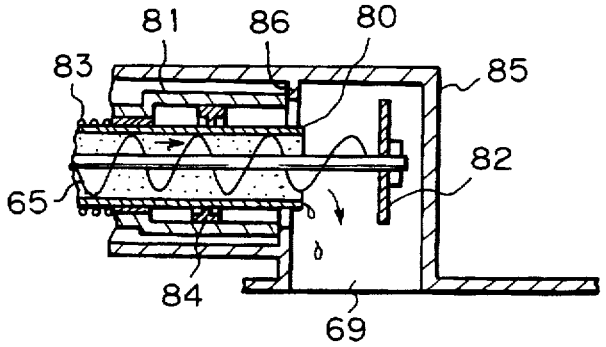

Moving means, not shown, is provided for moving the toner hopper unit 63Y. As shown in FIG. 7B, the moving means moves the unit 63Y toward the Y developing unit 26. Then, as shown in FIG. 7C, the sleeve 81 abuts against a projection 86 extending inward from the wall of a passage member 85 included in the developing unit 26. As a result, as shown in FIG. 7D, the packing member 82 is separated from the sleeve 81 with the result that the tube 80 is communicated to the passage member 85. In this manner, the unit 63Y is selectively brought into communication with the developing unit 26, setting up the toner replenishing path from the unit 63Y to the developing unit 26.

The BK developing unit 23, C developing unit 24 and M developing unit 25 are respectively connected to the toner hopper units 63BK, 63C and 63M in exactly the same manner as the Y developing unit 26 is connected to the toner hopper unit 63.

As shown in FIG. 4B, remaining toner sensing means 87 is mounted on the toner hopper unit 63Y and implemented by a piezoelectric toner end sensor. The toner end sensor 87 has a sensing surface 87a positioned on the inner periphery of the lower portion of the hopper portion 79. Among the plurality of elastic blades 71, the blade 71a positioned at the end is aligned with the sensing surface 87a of the toner end sensor 87, so that it slides on and cleans the surface 87a while in rotation. Such a configuration is also true with the other toner hopper units 63BK, 63C and 63M.

Figure 1:
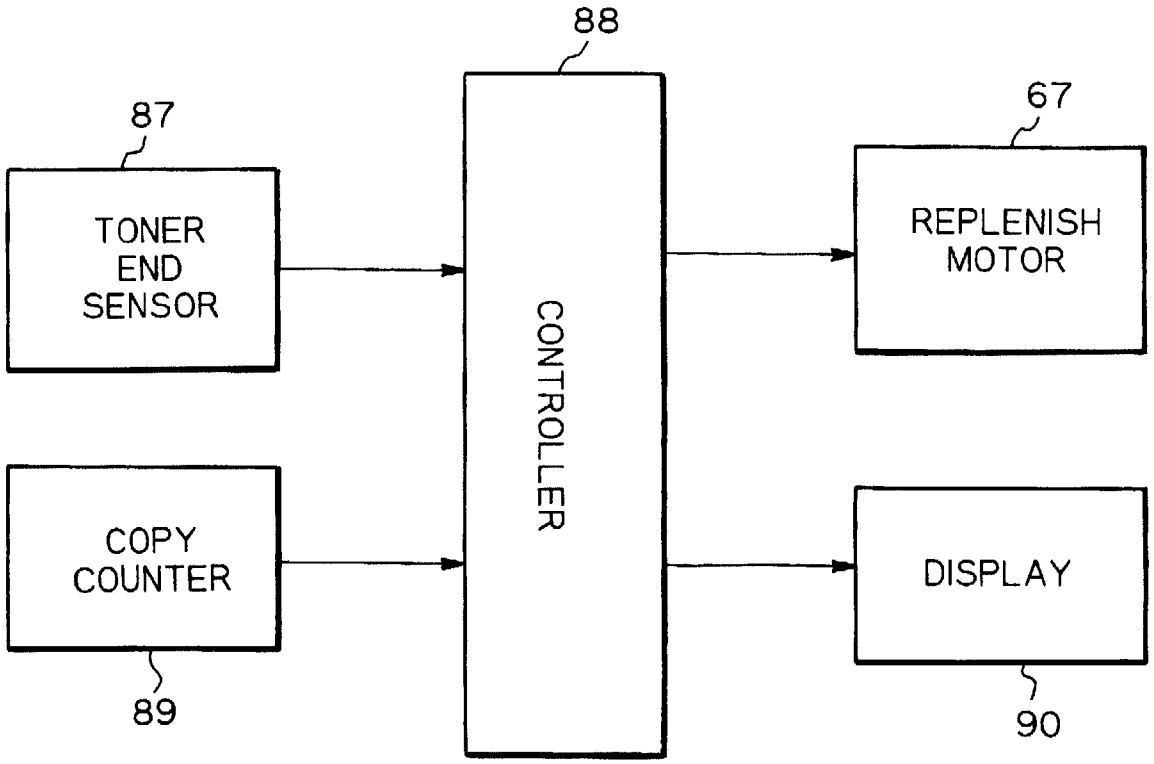
FIG. 1 is a block diagram schematically showing a control arrangement included in an electrophotographic color copier to which a first embodiment of the toner replenishing device in accordance with the present invention is applied.
Figure 2B:
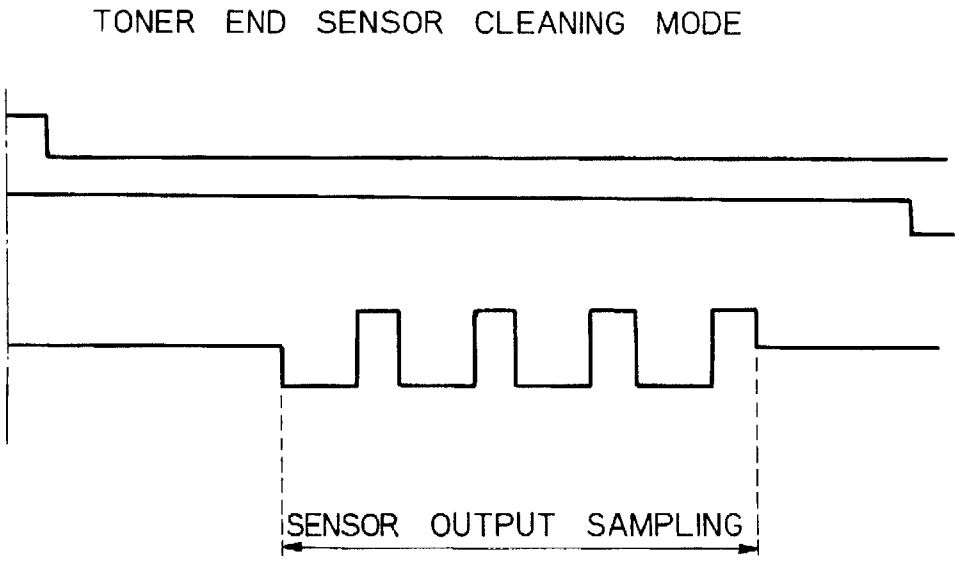
FIGS. 2A and 2B are timing charts respectively demonstrating toner replenishing mode control and toner end sensor cleaning mode control particular to the first embodiment.
Figure 2A:
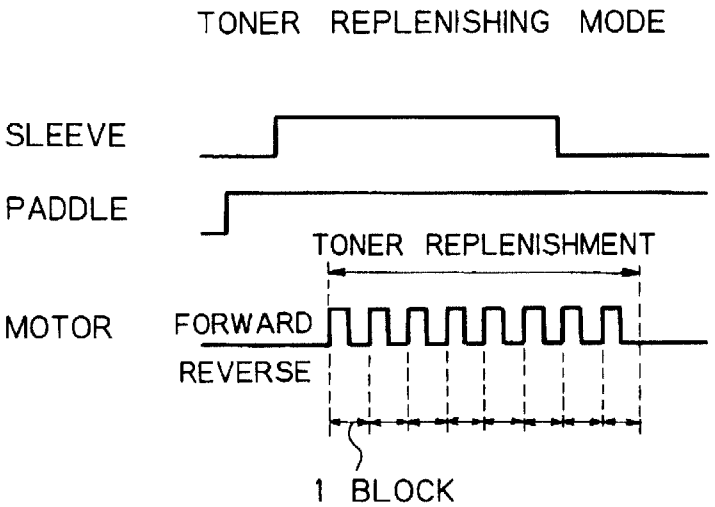

FIG. 1 shows a control arrangement included in the color copier. As shown, a controller or control means 88 is implemented by a microcomputer or CPU (Central Processing Unit). The toner end sensors 87 associated with the toner hopper units 63BK, 63C, 63M and 63Y send their outputs to the controller 88. Also, a copy counter 89 and the density pattern sensor 27 send their outputs to the controller 88. In response, the controller 88 controls the motors 67 of the toner hopper units 63BK, 63C, 63M and 63Y and a display 90. The copy counter 89 counts the cumulative number of copies produced by the color copier. FIGS. 2A and 2B are timing charts respectively representative of toner replenishing mode control and toner end sensor cleaning mode control executed by the controller 88.

During usual image formation, the controller 8 determines, by using the previously stated toner replenishment control system, an amount of toner to be replenished from each of the toner hopper units 63BK, 63C, 63M and 63Y to the developer existing in the associated one of the developing units 23–26. First, the controller 88 uses, as parameters, the amounts of toner consumption estimated from the image data of different colors, the toner concentrations of the developers of different colors, etc. The controller 88 computes, based on such parameters and by use of a fuzzy theory, the amount of toner to be replenished color by color. At this instant, the prerequisite is that the toner of each color be replenished evenly over a preselected replenishable period of time (usually during development) so as to prevent the toner concentration from sharply changing or becoming offset. To meet this prerequisite, the controller 88 equally divides the replenishable time into blocks and determines an amount of replenishment for each block. Further, the controller 88 determines the duration of rotation of the screw 65 of each of the toner hopper units 63BK, 63C, 63M and 63Y, taking account of the toner replenishing ability of the toner hopper unit based on, e.g., the amount of remaining toner.

For the above toner replenishment control system, use may be made of a system disclosed in, e.g., the fifth embodiment of Japanese Patent Laid-Open Publication No. 7-229881. In accordance with the system taught in this document, a reference pattern signal generator sequentially sends BK, C, M and Y reference pattern signals to the writing unit 11 during the formation of BK, C, M and Y images, respectively, once for ten copies. The writing unit 11 sequentially transforms the reference pattern signals to corresponding optical signals and thereby sequentially forms latent images representative of BK, C, M and Y reference patterns.

The latent images representative of the BK, C, M and Y reference patterns are respectively developed by the developing units 23–26 to turn out BK, C, M and Y reference toner images. Specifically, a white pattern and the BK, C, M and Y patterns are formed. The density pattern sensor 27 optically senses the density of each of such patterns. The controller 88 causes an analog-to-digital converter to digitize the outputs of the sensor 27. The controller 88 computes a ratio $V_{SP}/V_{SG}$ (density ratio) of the output of the sensor 27 representative of each of the BK, C, M and Y patterns to the output of the same representative of the white pattern.

Let the following description concentrate on the control over the toner concentration of the developer existing in the Y developing unit 26 by way of example. The controller 88 determines a difference between the output value of the toner concentration sensor 26c and a target toner concentration. Then, the controller 88 estimates, based on the fuzzy theory, an amount of toner replenishment (a degree of change) for a unit image (unit Y pattern image) in accordance with the above difference and a difference between the current and last output values of the toner concentration sensor 26c. The controller 88 computes and stores an amount of toner replenishment for a unit Y image forming signal on the basis of the above degree of change. The controller 88 counts the unit Y image forming signals with a counter and computes, based on the count and the amount of toner replenishment for a unit Y image forming signal, an amount of toner suitable for the above Y image forming signals. Subsequently, the controller 88 repeatedly turns on and turns off the motor 67 such that the toner is replenished from the toner hopper unit 63Y into the Y developing unit 26 in the computed amount. Further, the controller 88 changes the target toner concentration of the Y developing unit 26 in accordance with the difference between the current and last output values of the toner concentration sensor 26c and a difference between the current and last ratios $V_{SP}/V_{SG}$ associated with the Y reference pattern image.

In the above condition, as shown in FIG. 2A, the controller 88 sets a preselected period of time for toner replenishment to occur while the Y developing unit 26 is in operation. The above period of time consists of a sequence of blocks each lasting a preselected period of time (200 msec in the embodiment). The controller 88 changes the frequency of the above block, depending on the size of papers sensed by paper size sensing means. The controller 88 determines, based on the computed amount of toner replenishment, the ratio of the operation time of the motor 67 in one block as a toner replenishment duty ratio. Of course, the controller 88 controls the replenishment of toner from the toner hopper unit 63BK to the BK developing unit 23, the replenishment of toner from the C toner hopper unit 63C to the C developing unit 24, and the replenishment of toner from the toner hopper unit 63M to the M developing unit 25 in the same manner as described above in relation to the toner hopper unit 63Y.

The operation of the motor 67 to occur in the toner end sensor cleaning mode will be described hereinafter. In the toner hopper unit 63Y, for example, the motor 67 drives the agitator 69 and drives the blade or cleaning member **71*a* via the agitator 69. The controller 88 sets up the toner end sensor cleaning mode every time the total number of copies counted by the copy counter 89** exceeds a preselected number (fifty in the embodiment), but after a desired number of copies have been produced.

As shown in FIG. 2B, in the toner end sensor cleaning mode, the motor 67 is repeatedly rotated in the forward and reverse directions a preselected number of times over a preselected period of time. In the illustrative embodiment, the motor 67 repeats a cycle consisting of 0.5 sec of forward rotation and 1 sec of reverse rotation four consecutive times. The cycles are selected such that during the above preselected period of time the blade **71*a* wipes the surface 87*a* of the toner end sensor 87 at least more than once due to the rotation of the agitator 69**.

If desired, the blade **71*a* may be rotated only in the reverse direction. This is rather desirable in consideration of the sensing surface 87*a* of the toner end sensor 87. Specifically, it is important that the blade 71*a* cleans the sensing surface 87*a* in a continuous motion. In this sense, the momentary stop between the forward and reverse rotations is not desirable. However, the momentary stop is not critical because the processing of the output of the sensor 87**, which will be described later, is relatively easy due to the regularity of the forward and reverse rotations.

Conversely, rotating the blade **71*a* only in the forward direction is not practicable at all because it would rotate the screw 65 and cause it to convey toner, noticeably varying the toner concentration. This is why the blade 71*a* is rotated for a longer period of time in the reverse direction than in the forward direction. The ratio between the duration of the forward rotation and that of the reverse rotation is selected such that the replenishment of the toner by the screw 65** is not questionable.

As stated above, the embodiment causes the blade **71*a* to rotate in opposite directions because such a scheme, although disadvantageous in a sense, is extremely effective against the cohesion of the toner in the toner hopper unit 63Y**.

The controller 88 samples the output signals of the toner end sensor 87 at preselected times during the course of a toner end sensor cleaning mode, thereby determining whether or not the toner hopper unit 63Y has reached its toner end condition. When the unit 63Y reaches the toner end condition, the controller 88 causes it to be displayed on the display 90. The controller 88 executes the above motor control and toner end display control also with the other toner hopper units 63BK, 63C and 63M.

As described above, in the illustrative embodiment, the toner replenishing device has the hopper portion 79, toner end sensor 87 having the sensing surface **87*a*, screw 65 for agitating the toner in the hopper portion 79, and blade 71*a* driven by the same drive source as the screw 65 for cleaning the sensing surface 87*a*. The controller 88 causes the blade 71*a* to clean the sensing surface 87*a* by being driven in a particular manner different from the manner for replenishing the toner. During the cleaning operation, the controller 88 detects the output of the remaining toner sensing means 87**. With this construction, the embodiment achieves both the highly accurately toner concentration control and the toner end detection.

Figure 9B:
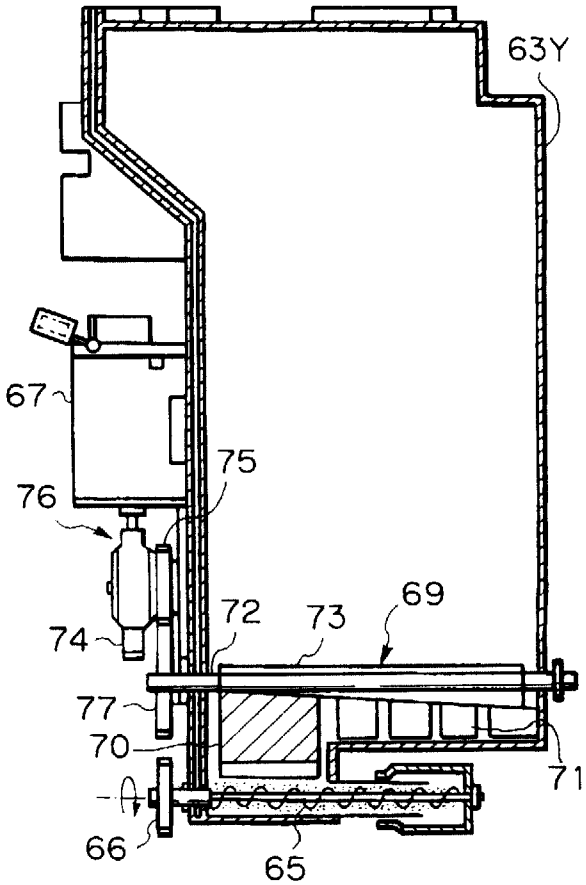
FIGS. 9A and 9B are sections showing the general arrangement of the second embodiment.
Figure 9A:
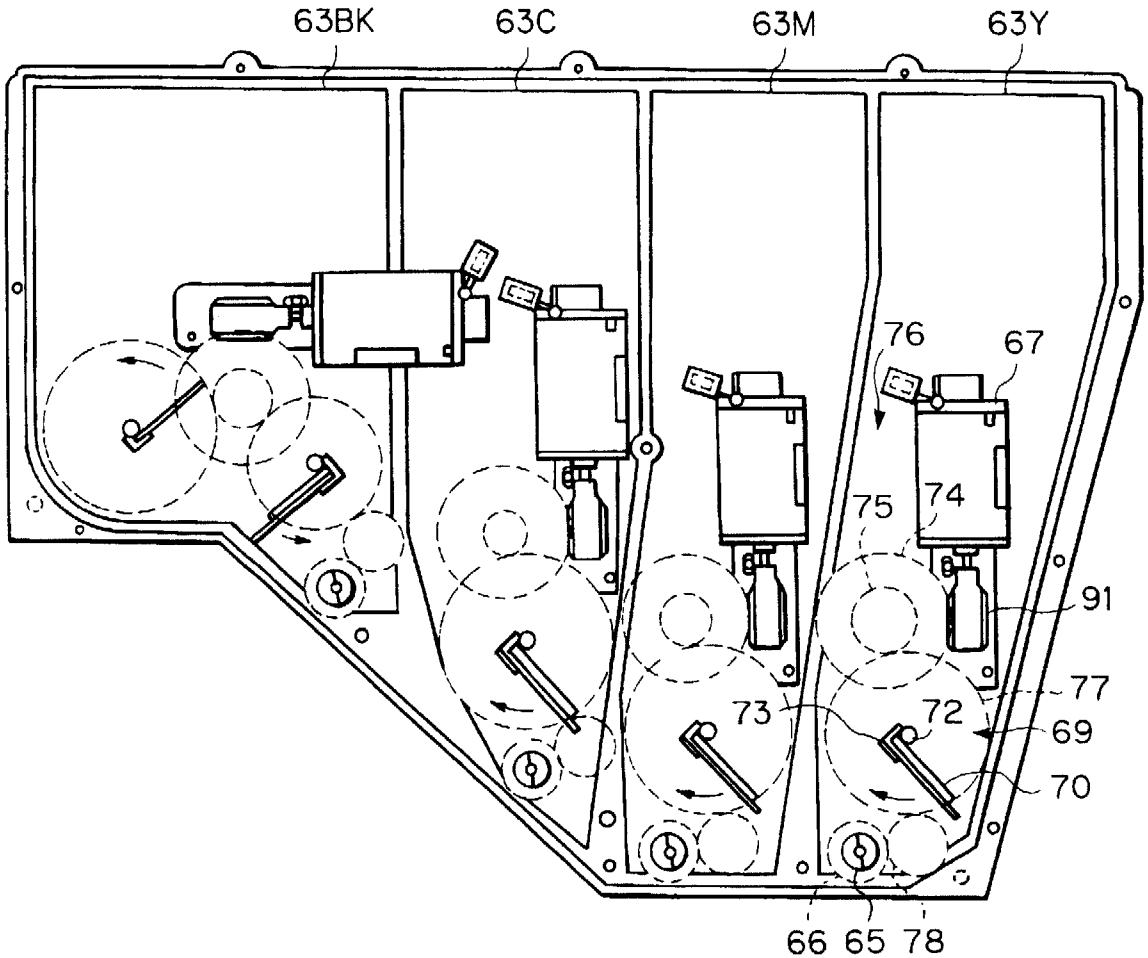
Figure 10:
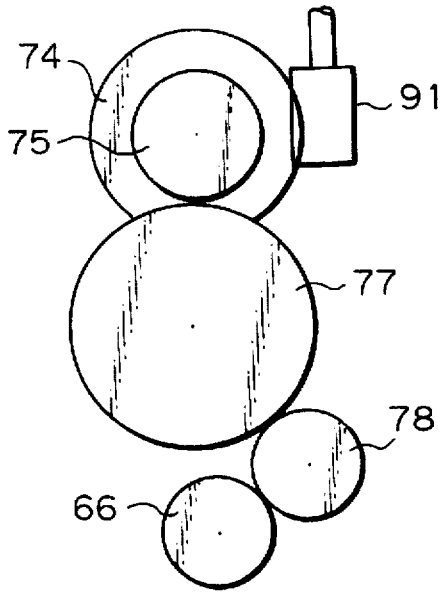
FIG. 10 is a section showing a gear drive mechanism included in the second embodiment.

A reference will be made to FIGS. 9A, 9B and 10 for describing a second embodiment of the present invention.

This embodiment is also applied to the color copier described in relation to the first embodiment. As shown, the BK, C, M and Y toner hopper units 63BK–63Y each has the motor or drive source 67, agitator 69 with gear 77 coaxially mounted thereon, and screw 65 with the gear 66 coaxially mounted thereon. These structural elements are interlocked via the gear 78, so that the agitator 69 and screw 65 are driven by a single drive source 67.

Figure 8:
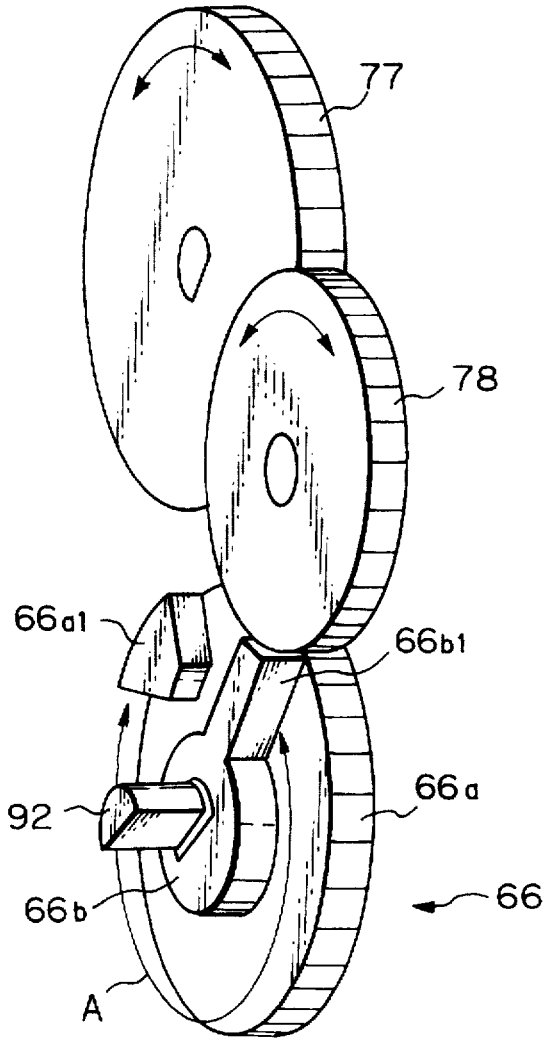
FIG. 8 is a perspective view of a gear train representative of a second embodiment of the present invention.
Figure 11A:
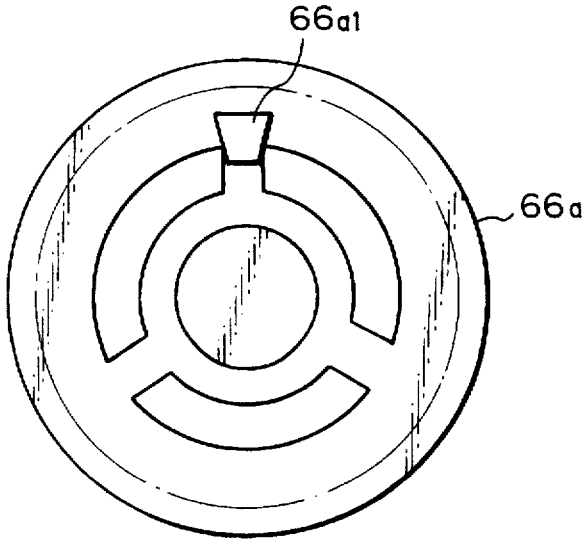
FIGS. 11A and 11B are respectively a plan view and a side elevation showing an idler gear also included in the second embodiment.
Figure 11B:
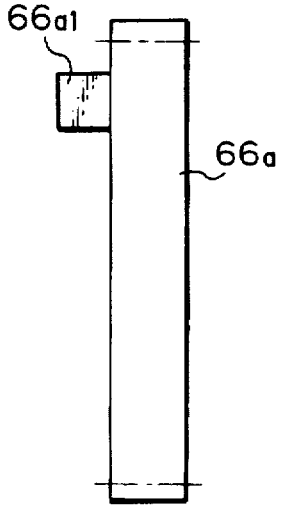
Figure 12:
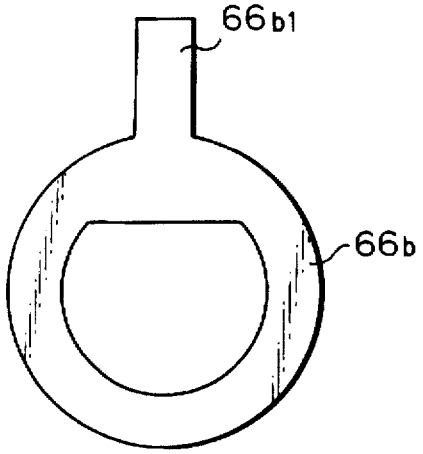
FIG. 12 is a plan view of a joint member also included in the second embodiment.

The worm 91 mounted on the output shaft of the motor 67 is held in mesh with the worm gear 74. The rotation of the worm gear 74 is transmitted to the gear 66 via the gears 75, 77 and 78. As shown in FIG. 8, the gear 66 is made up of an idler gear **66*a* and a joint member 66*b*. As also shown in FIGS. 11A and 11B, the idler gear 66*a* is rotatably mounted on a shaft 92 and includes a projection $66a_1$. As also shown in FIG. 12, the joint member 66*b* is affixed to the shaft 92 and includes a stop portion $66b_1$. The idler gear 66*a* and joint member 66*b* are mounted on the shaft 92** in contact with each other.

The output torque of the motor 67 is transferred to the idler gear **66*a* via the worm 91, helical gear 76, and gears 77 and 78. Because the idler gear 66*a* is rotatable relative to the shaft 92, the rotation of the gear 66*a* is not transferred to the screw or toner conveying member 65 despite the driving force acting thereon. However, the rotation of the idler gear 66*a* is transferred to the screw 65 only when the projection $66_1$ of the gear 66*a* is stopped by the stop portion $66a_1$ of the joint member 66. In this condition, the joint member 66 is forced by the idler gear 66*a*** to rotate.

Specifically, as shown in FIG. 8, the projection $66a_1$ of the idler gear **66*a* is not restricted by the stop portion $66b_1$ of the joint member 66*b* over an angular range (play range) indicated by an arrow. Hence, the rotation of the idler gear 66*a* is not transferred to the screw 65 over the above play range, i.e., the idler gear 66*a* can freely rotate with the screw 65 remaining in a halt over the play range. In the toner loosening mode, despite that the agitator 69 is rotated in opposite directions, the transmission of the rotation to the screw 65 is delayed by the play range A. This successfully reduces the amount of rotation of the screw 65 and therefore the amount of toner to be conveyed into the Y developing unit 26. The above configuration is also true with the other toner hopper units 63BK, 63C and 63M**.

As stated above, this embodiment allows the output torque of the drive source 67 to be variably transmitted to the toner conveying member 65. As a result, the amount of excess toner to be replenished into each developing unit is reduced. This advantage is further enhanced by the idler gear **66*a* with the projection $66a_1$, and the joint member 66*b*** with the stop portion $66b_1$.

Figure 13:
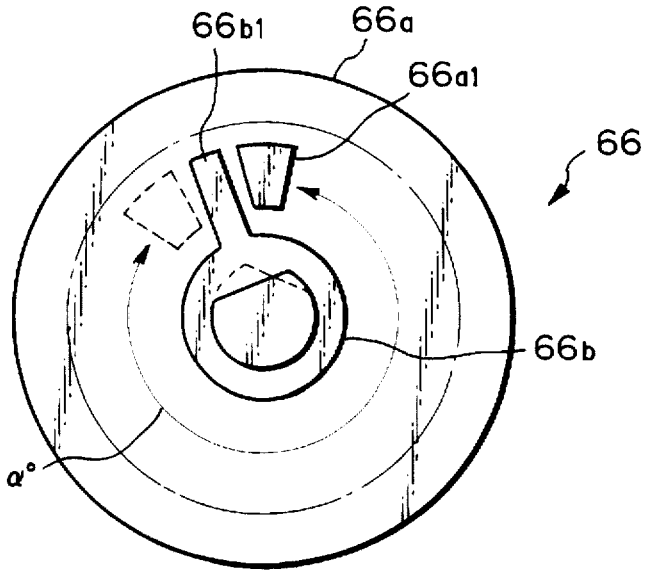
FIG. 13 shows a third embodiment of the present invention, particularly the play angle of the idler gear relative to the joint member.

A third embodiment of the present invention will be described hereinafter. As shown in FIG. 13, assume that the play or idle angle of the idler gear **66*a* relative to the joint member 66*b* is $\alpha$ degrees, and that in the toner loosening mode the agitator 69 rotatable in opposite directions rotates forward over an angle of $\beta$ degrees. Then, in the illustrative embodiment, the angle $\beta$ is selected to be smaller than or equal to the angle $\alpha$. In this configuration, in the loosening mode, although the idler gear 66*a* rotates $\beta$ degrees during the forward rotation of the agitator 69, the play angle $\alpha$ is fully absorbed. As a result, the projection $66a_1$ of the idler gear 66*a* is not stopped by the stop portion $66b_1$ of the joint member 66*b*. This prevents the force causing the agitator 69 to rotate from being transferred to the toner conveying member 65, i.e., prevents the member 65 from conveying the toner. Such a configuration is also true with the other toner hopper units 63BK, 63C and 63M**.

As stated above, in the above embodiment, the angle over which the agitator 69 is rotatable in opposite directions rotates in the forward direction is selected to be greater smaller than or equal to the maximum angle over which the idler gear **66*a* idles. This noticeably reduces the amount of excess toner to be conveyed into the developing units 23–26. If desired, the above relation $\beta \leqq \alpha$ may be replaced with a relation $\beta' \leqq \alpha'$ where $\alpha'$ and $\beta'$ are respectively representative of the duration of the idling of the idler gear 66*a* and the duration of the forward rotation of the agitator 69**.

A fourth embodiment of the present invention is as follows. During the forward rotation of the screw or toner conveying member 65, the screw 65 conveys the toner. Assume that when the rotation of the agitator 69 in opposite directions ends in the toner loosening mode, the idler gear **66*a* reaches a reverse drive position, i.e., a position where the reverse drive side of the projection $66a_1$ is stopped by the stop portion $66b_1$ and will drive the screw 65 immediately on the reverse rotation of the agitator 69. Such positions of the projection $66a_1$ and stop portion $66b_1$ are indicated by solid lines in FIG. 13. Then, the controller 88 additionally controls the motor 67 such that the idler gear 66*a* necessarily reaches, at the end of the forward and reverse rotation of the agitator 69, a forward drive position, i.e., a position where the forward drive side of the projection $66a_1$ is stopped by the stop portion $66b_1$ and will drive the screw 65 immediately on the forward rotation of the agitator 69. More specifically, the controller 88 causes the idler gear 66*a* to rotate a degrees away from the reverse drive position to bring its projection $66a_1$ to a position indicated by a phantom line in FIG. 13, and then ends the forward and reverse rotation of the agitator 69. This surely brings the idler gear 66*a*** to a stop at the forward drive position without fail in the toner loosening mode.

In the loosening mode, if the idler gear **66*a* ends its reversible rotation at the reverse drive position, then the reverse drive side of the projection. $66a_1$ is stopped by the stop portion $66b_1$ of the joint gear 66*b*. Assume that a copying operation begins, i.e., the controller 88 sends a toner replenish signal to the motor 67 to thereby drive it in the above condition. Then, the screw 65 actually replenishes the toner only after the play angle $\alpha$ of the idler gear 66*a* has been absorbed, i.e., after the projection $66a_1$ has moved from the solid line position to the phantom line position shown in FIG. 13**. As a result, the response as to toner replenishment is lowered in the loosening mode.

However, in the illustrative embodiment, the period of time necessary for the play angle $\alpha$ of the idler gear **66*a* to be absorbed is eliminated. Therefore, when the motor 67 starts rotating in response to the toner replenish signal, the screw 65** starts rotating and feeding toner immediately without any interval.

As stated above, in the fourth embodiment, when the screw 65 tends to stop at the reverse drive position during the forward and reverse rotation of the agitator 69, the controller 88 causes the agitator 69 to rotate forward an angle corresponding to the play angle. This successfully causes the screw 65 to stop rotating at the forward drive position without fail and thereby enhances the response just after the loosening mode operation.

In summary, it will be seen that the present invention provides a simple and space-saving toner replenishing device capable of achieving highly accurate toner concentration control and toner end detection at the same time, reducing excess toner otherwise replenished into a developing device, and enhancing response as to toner replenishment after a toner loosening mode operation.

Various modifications will become possible for those skilled in the art after receiving the present disclosure without departing from the scope thereof. For example, the present invention is applicable not only to the toner replenishing device of a color copier but also to the toner replenishing devices of other image forming apparatuses including a monocolor copier and a copier, facsimile apparatus or printer not using an intermediate transfer belt.

What is claimed is:

1. A toner replenishing device comprising:

a hopper portion for storing toner therein;

remaining toner sensing means having a sensing surface disposed in said hopper portion to thereby sense the toner existing in said hopper portion;

agitating means for agitating the toner in said hopper portion;

cleaning means driven by a same drive source as said agitating means for cleaning said sensing surface of said remaining toner sensing means; and means for causing said cleaning means driven by said same drive source to clean said sensing surface by a drive operation different from a drive operation of the toner agitating means by said same drive source during usual toner replenishment, and detecting an output of said remaining toner sensing means while said cleaning means cleans said sensing surface.

2. A toner replenishing device comprising:

a hopper portion for storing toner therein;

an agitating member for agitating the toner in said hopper portion;

a toner conveying member driven by the same drive source as said agitating member for replenishing the toner into a developing device during a toner replenishing operation;

wherein an output torque of said drive source to said toner conveying member is variably transmitted during the toner replenishing operation.

3. A toner replenishing device as claimed comprising:

a hopper portion for storing toner therein;

an agitating member for agitating the toner in said hopper portion;

a toner conveying member driven by the same drive source as said agitating member for replenishing the toner into a developing device;

an idler gear mounted on a shaft of said toner conveying member rotatably relative to said shaft, and receiving a driving force from said agitating member, said idler gear having a projection on one of opposite major surfaces thereof; and a joint member affixed to said shaft of said toner conveying member, and having a stop portion for causing, on stopping said projection, said idler gear to idle until said idler gear has been driven by said agitating member;

wherein drive transmission from said drive source to said toner conveying member is variable.

4. A device as claimed in claim 3, wherein said agitating member rotatable in opposite directions rotates in a forward direction over an angle greater than or equal to a maximum angle over which said idler gear idles.

5. A device as claimed in claim 3, wherein said toner conveying member conveys the toner while rotating in a forward direction, and wherein said device further comprises means for causing, when said toner conveying member tends to stop in a reverse rotation during forward and reverse rotation of said agitating member, said agitating member to rotate in the forward direction over an angle equal to an angle over which said idler gear idles, thereby causing said toner conveying member stop in a forward rotation.

* * * * *